US011619123B2

(12) United States Patent
Dunbar

(10) Patent No.: US 11,619,123 B2
(45) Date of Patent: Apr. 4, 2023

(54) DUAL SYNCHRONIZED MEASUREMENT PUCK FOR DOWNHOLE FORCES

(71) Applicant: Halliburton Energy Services, Inc., Houston, TX (US)

(72) Inventor: Bradley David Dunbar, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 610 days.

(21) Appl. No.: 16/668,273

(22) Filed: Oct. 30, 2019

(65) Prior Publication Data

US 2021/0131263 A1 May 6, 2021

(51) Int. Cl.
*E21B 47/007* (2012.01)
*E21B 12/00* (2006.01)
*E21B 10/43* (2006.01)

(52) U.S. Cl.
CPC ..... *E21B 47/007* (2020.05); *E21B 10/43* (2013.01); *E21B 12/00* (2013.01)

(58) Field of Classification Search
CPC ..... E21B 10/43; E21B 10/00; E21B 12/00; E21B 2200/20; E21B 44/00; E21B 47/007; E21B 47/01
See application file for complete search history.

(56) References Cited

U.S. PATENT DOCUMENTS 3,968,473 A 7/1976 Patton et al.
7,168,506 B2 1/2007 Boucher et al.
7,604,072 B2 10/2009 Pastusek et al.
7,849,934 B2 12/2010 Pastusek et al.
8,100,196 B2 1/2012 Pastusek et al.
8,162,077 B2 4/2012 Glasgow et al.
8,245,792 B2 8/2012 Trinh et al.
8,573,326 B2 11/2013 Trinh et al.
8,967,295 B2 3/2015 Habernal et al.
9,121,258 B2 9/2015 Kumar
9,297,248 B2 * 3/2016 Yao ..... E21B 12/00
9,372,124 B2 6/2016 Schlosser
9,458,714 B2 10/2016 Gajji et al.
(Continued)

FOREIGN PATENT DOCUMENTS

WO WO2010144538 A2 12/2010

OTHER PUBLICATIONS

U.S. Appl. No. 16/668,671 Non-Final Office Action, dated Mar. 3, 2021, 7 pages.

*Primary Examiner* — Caroline N Butcher
(74) *Attorney, Agent, or Firm* — Delizio, Peacock, Lewin & Guerra

(57) ABSTRACT

A downhole drilling tool comprises an earth-boring drill bit including a bit body and a shank coupled to the bit body. The drill bit includes a motion puck positioned in a cavity of the shank, wherein the motion puck includes a motion sensor to detect movement indicating a force applied to the earth-boring drill bit during a drilling operation. The drill bit includes a strain puck positioned in the cavity of the shank, wherein the strain puck includes a strain gauge to measure the force applied to the earth-boring drill bit during the drilling operation. The drill bit includes a plurality of blades disposed on exterior portions of the bit body, each blade having respective cutting elements disposed thereon.

19 Claims, 6 Drawing Sheets

(56) References Cited

U.S. PATENT DOCUMENTS

| | | | | |
|---|---|---|---|---|
| 2006/0065395 | A1* | 3/2006 | Snell | E21B 47/01 175/45 |
| 2011/0024188 | A1 | 2/2011 | Wassell et al. | |
| 2013/0105221 | A1 | 5/2013 | Wassell | |
| 2014/0246235 | A1* | 9/2014 | Yao | E21B 47/007 175/40 |
| 2018/0066513 | A1* | 3/2018 | Sugiura | E21B 47/01 |

* cited by examiner

DUAL SYNCHRONIZED MEASUREMENT PUCK FOR DOWNHOLE FORCES

BACKGROUND

The disclosure generally relates to the field of drilling tools and to measuring devices.

In oil and gas production processes, drill bits drill a wellbore in a subsurface formation by mechanically removing rock from the subsurface formation. Throughout a drilling operation, a drill bit may be subjected to various forces acting on the drill bit. The forces, which can include tension, torsion, bending, pressure, and temperature, result in an applied strain and unintended motion or vibration of the drill bit. Weight-on-bit (WOB) is the amount of downward force exerted by a drill string during drilling operations. The amount of WOB depends on the entire weight of the drill string and tensile forces applied at the rig. Torsion forces, or torque-on-bit (TOB), are applied to the drill string to provide cutting torque at the drill bit by a motor rotating the drill bit. Contact with the subsurface formation can lead to bending of the drill bit (BOB). These forces may result in wear on a drill bit or cause premature drill bit failure. Sensors may be used to collect data on each of the forces downhole which may be analyzed to adjust drilling operations to limit the impact of these forces on the drill bit.

BRIEF DESCRIPTION OF THE DRAWINGS

Embodiments of the disclosure may be better understood by referencing the accompanying drawings.

DESCRIPTION

Figure 1:
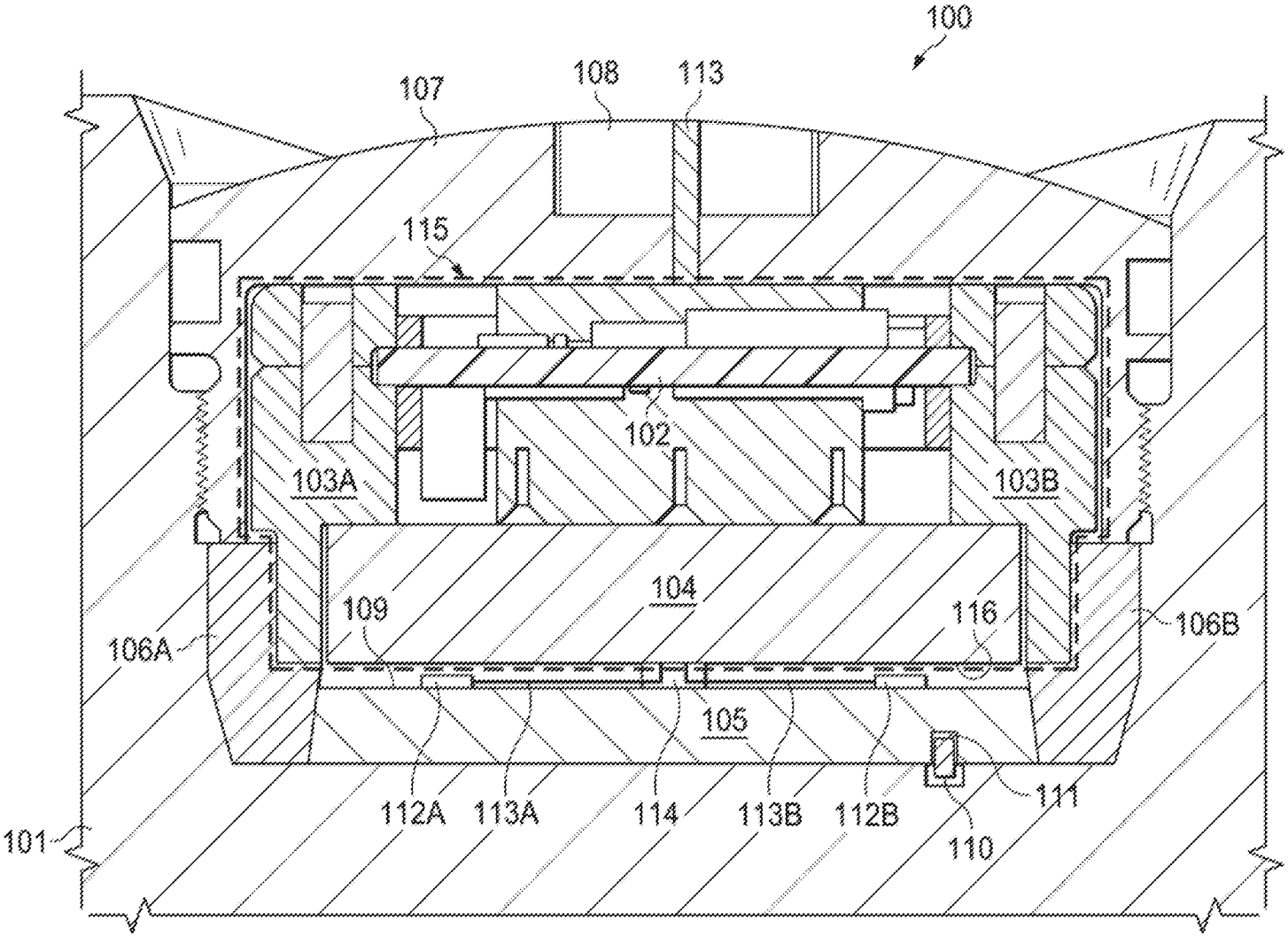
FIG. 1 depicts a multi-puck measurement package inserted in a cavity of a body of a subassembly.

The description that follows includes example systems, methods, techniques, and program flows that embody embodiments of the disclosure. However, it is understood that this disclosure may be practiced without these specific details. For instance, this disclosure refers to a dual synchronized measurement puck system on the shank of a drill bit in illustrative examples. Aspects of this disclosure can be also applied to a synchronized multi-puck measurement package on other locations of a subassembly of a tool or drill string (e.g., a drill bit), such as in a cavity on a blade of a drill bit. In other instances, well-known instruction instances, protocols, structures and techniques have not been shown in detail in order not to obfuscate the description.

Overview

In accordance with some embodiments, a compact multi-puck assembly combines multiple measurement pucks into a single assembly/package and allows for synchronization and communication of the multiple measurement pucks without complex and costly wiring unsuitable for the challenging environment of hydrocarbon extraction. In addition, the compactness yielded by the combination of multiple measurement pucks allows for efficient installation of the measurement pucks which can lower cost. The compact multi-puck apparatus includes measurement pucks that measure different aspects of forces applied to a subassembly. The multiple measurement pucks are inserted into a cavity or pocket of a collar or shank of a subassembly to measure values relating to motion, vibration, stress, and strain on the subassembly.

A first of the measurement pucks may be a support structure with strain gauges coupled thereto (mechanical strain puck). A second measurement puck may be a housing structure that houses one or more measurement devices to measure forces relating to motion. This motion puck houses at least one motion related sensor which is coupled to processing and circuitry (e.g., bus circuitry) to combine motion related measurement capabilities of one or more sensors into a single puck. The motion related sensors can include a gyroscope, a magnetometer, and/or an accelerometer. Shank motion can be measured using one motion related sensor. Multiple motion related sensors may also be used. Combining measurements obtained with multiple sensors allows for cross checking the measurements from different sensors to validate the data. The motion puck and the strain puck are communicatively coupled to synchronize with each other and simultaneously detect motion, vibration, and strain on a subassembly. Both pucks are retained in a cavity in the shank of a subassembly allowing a single cavity to be used for multiple measurement pucks.

In a likely deployment of using more than one multi-puck apparatus to obtain measurements at different locations on the subassembly, a reduced communication infrastructure propagates across the multi-puck apparatuses. Obtaining measurements at different locations on a subassembly allows for better understanding of the forces acting on the entire subassembly instead of the localized forces acting at each cavity location. Data from each multi-puck assembly may be analyzed to identify various strain forces and distinguish similar forces. The identified forces may be used to modify downhole drilling parameters in order to reduce the impact of certain forces on the subassembly, plan maintenance operations, etc. With the combined measurement pucks in each cavity, communication among multi-puck assemblies at different locations can be obtained without increasing wiring around the subassembly.

Example Illustrations

FIG. 1 depicts a multi-puck measurement package inserted in a cavity of a body of a subassembly. A compact multi-puck measurement system ("measurement package") 100 comprises multiple measurement pucks housed within a cavity in section of a shank 101 of a drill bit. A first puck (motion puck) 115 (surrounded by a dashed line) measures motion and vibration of the shank 101 through sensors, or chips, on a PCB 102. The PCB 102 may be an electronic package comprising one or more motion related measurement sensors such as a gyroscope, a magnetometer, and/or an accelerometer. The motion related sensors on the PCB 102 measure motion and vibration associated with the rotational velocity and angular acceleration of the shank 101. The PCB 102 is stabilized by PCB holders 103A and 103B. While depicted as two components on either end of the PCB 102, the PCB holder may also be a single device surrounding the PCB 102 on all sides. A battery 104 powers the PCB 102 and the measurement package 100. The motion puck 115 includes a housing that houses the PCB 102, the PCB holders 103A and 103B, and the battery 104.

Below the motion puck 115 is a strain puck 105. While the strain puck 105 is depicted contacting a lower motion puck surface 116 below the battery 104 in FIG. 1, other configurations are possible. For example, the PCB 102 may be situated between the battery 104 and the strain puck 105. The strain puck 105 is confined by a retaining member, or a strain puck wedge (106A and 106B), which circumferentially surrounds the strain puck 105 and transfers forces acting on the shank 101 to the strain puck 105.

The strain puck 105 has a surface 109. The surface 109 may be a flat surface or may have a raised outer ledge. Strain gauges 112A and 112B on the surface 109 measure strain forces transferred from the shank 101 to the strain puck 105. While the strain gauges 112A and 112B are depicted as sitting on the surface 109, other configurations are possible. For example, the strain gauges may be housed in recesses in the surface 109 so that the strain gauges 112A and 112B lie flush with the surface 109. While two strain gauges are depicted in FIG. 1, any number of strain gauges may be applicable.

The strain puck 105 may include an alignment slot 111. An alignment pin 110 on the shank 101 may be placed within the alignment slot 111 to ensure proper alignment of the strain puck 105 with the cavity of the shank 101. Maintaining alignment through the coupling of the alignment pin 110 and the alignment slot 111 may ensure that each strain gauge on the surface 109 is aligned to measure the strain forces transferred to the strain puck 105 from the shank 101.

The PCB 102 and the strain puck 105 are synchronized in a single package that measures strain forces, internal and external pressure forces, and motion. The PCB 102 in the motion puck 115 and the strain puck 105 are configured to communicate data from the strain gauges 112A and 112B on the strain puck 105 to the PCB 102 of the motion puck. A communication infrastructure communicatively couples the strain puck 105 to the motion puck 115. The communication infrastructure comprises the connections, wires, and wireless means of transmitting data between the strain gauges 112A and 112B and the PCB 102. Communication may be transmitted through a connector 114 in which the contacting surfaces of the motion puck, surface 116, and the strain puck, surface 109, are hardwired to allow measurements from the strain gauges to be communicated to a processor on the PCB 102. In some embodiments, communication may be transmitted through fiber optic or wireless communication methods. In other embodiments, the PCB 102 and the strain puck 105 may be connected through an interface in which pins (not shown) connect the PCB 102 to a connector (not shown) on the surface 109 of the strain puck 105. The strain gauges 112A and 112B may be connected to the connector 114 through wires 113A and 113B, respectively.

Enclosing the measurement package on the outer diameter of the shank 101 is a pressure cap 107. The pressure cap 107 protects the electronics within the pucks and distributes the pressure forces on the shank 101 to the motion and strain pucks. The pressure cap 107 includes a cap torque sensor 108 that measures torque on the shank 101. The pressure cap 107 may include a hollow passage 113 to allow communication wires (not shown) to connect to the PCB 102.

Multiple measurement packages can be attached to various cavities, or recesses, distributed across the drill bit. These recesses may be already in the shank of the drill bit or may be machined specifically to house the measurement pucks. Data received from strain gauges disposed on each of the strain pucks of each measurement package may be used simultaneously for analysis to determine downhole forces being applied to the drill bit. This data can be used to identify a direction of a bending force and/or to determine whether a weight and/or a tensile force is symmetric around the drill bit. The measurement package can be synchronized to communicate forces acting on the drill bit at distributed locations. As examples, two measurement packages may be distributed at 180-degrees; three measurement packages may be distributed at 120-degrees; four measurement packages may be distributed at 90 degrees; and so on. Any combination of measurement packages may be used as long as the angular difference between each measurement package is known.

Synchronization of multiple measurement packages allows strain force measurements acquired by the multiple strain pucks to be used to determine WOB and BOB values for the drill bit. Each strain puck detects tensile and compression forces through the associated strain puck wedge. A strain force analyzer, which may be part of the PCB, analyzes the measurements acquired from the measurement pucks distributed about the drill bit to determine WOB and BOB values. Uneven application of compression and tensile forces distinguishes WOB and BOB values. Compression forces may be used to determine WOB values as the weight applied to the drill bit compresses the puck wedge. However, multiple measurement packages are beneficial for determining BOB. The variation of compression and tensile forces across the drill bit may cause a bending of the drill bit when pressure forces on one location overcome the symmetric tensile forces. Thus, to accurately determine BOB values, a comparison of the tensile and pressure forces determined at the different measurement packages is used, where a greater compression force may indicate bending toward that location.

In another embodiment, BOB values may be determined using a measurement package in one cavity and a strain puck in another cavity. This allows for measurement of the global motion of the shank through a single measurement package while the two strain pucks, one as part of the measurement package and one individual strain puck, detect localized forces on the shank. In this embodiment, the measurement package in the first cavity measures the motion and vibration of the entire shank while the strain puck of the measurement package measures compression and tensile forces acting on the first cavity. The strain puck in the second cavity measures the compression and tensile forces acting on the second cavity. The strain puck in the second cavity is communicatively coupled to the PCB of the measurement package in the first cavity through wired or wireless methods. Any number of strain pucks distributed across the shank may be coupled to the PCB of the measurement package to obtain measurements across various locations of the shank.

Figure 2:
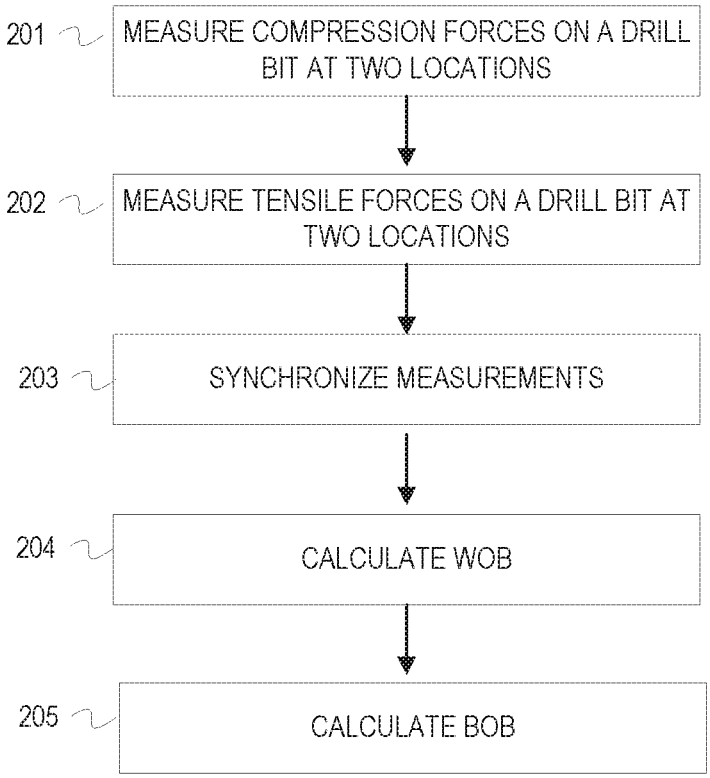
FIG. 2 depicts a flowchart of operations for calculating bending on a drill bit using synchronized multi-puck measurement packages.

FIG. 2 depicts a flowchart of operations for calculating bending on a drill bit using synchronized multi-puck measurement packages. FIG. 2 includes operations that can be performed by hardware, software, firmware, or a combination thereof. For example, at least some of the operations can be performed by a processor executing program code or instructions. The description refers to the program code that performs some of the operations as a strain force analyzer, although it is appreciated that program code naming and organization can be arbitrary, language dependent, and/or platform dependent. Operations of the flowchart of FIG. 2 start at block 201.

At block 201, compression forces on a drill bit are measured at two locations on a shank of the drill bit using two multi-puck measurement packages. Each measurement package is housed in a separate cavity on the shank. As an example, the two measurement packages can be situated 180-degrees apart on the drill bit. Each measurement package includes a strain puck. The strain puck is surrounded by a wedge that is in contact with the sides of the cavity of the shank. The wedge evenly transfers forces acting on the drill bit to sensors on the strain puck. When a drill bit is in contact with a subterranean formation, the formation applies an upward force on the drill bit. Simultaneously, the weight of the drill string above the drill bit applies a downward force on the drill bit. The upward and downward forces compress the drill bit causing the drill bit to become shorter and thicker. The wedge propagates the changes in the drill bit due to the compression and exerts corresponding forces onto the strain puck. Sensors on the strain puck quantitatively measure the compression forces acting on the drill bit from the changes in length and thickness of the drill bit detected by the wedge.

At block 202, the tensile forces on the drill bit are measured. Tensile forces acting on a drill bit tend to stretch the drill bit and make the drill bit thinner. Similar to the detection of compression forces in block 201, the wedge surrounding each strain puck propagates the changes in the drill bit due to the tensile forces and exerts corresponding effects of the tensile forces onto the strain puck where the sensors quantify the forces.

At block 203, the measurements obtained by each strain puck are synchronized. Each strain puck communicates the quantified compression and tensile forces to a PCB in a motion puck in the respective measurement package. The strain pucks may be hardwired to transfer data from the sensors on the strain puck to the PCB. The data may also be communicated wirelessly. The two measurement packages are synchronized, and data is communicated by a connection between the PCB of each measurement package. The PCBs may be connected through a wire or another means of connection that transmits the data, or the PCBs may also be able to wirelessly communicate the data to each other. In the embodiment with one measurement package including a strain puck in one cavity and a standalone strain puck in a different cavity or recess, data from both strain pucks are communicated to the PCB of the measurement package. In this embodiment the sensors of the individual strain puck are directly connected to the PCB of the measurement package.

One of the PCBs may contain programming to directly perform force calculations and analysis of the combined data from each measurement package. Data may be stored directly on the PCB, in a memory on the PCB, or the data may be transmitted from the PCBs to a wireless receiver located downhole. The wireless receiver may store the data in a secondary memory not on the PCB for future analysis. The PCB may also transmit the data directly to the secondary memory. The data may also be transmitted to a computer or another receiving device at the surface.

At block 204, WOB is calculated. A strain force analyzer calculates the WOB of the entire bit based on the measured compression forces at each recess in the shank. The strain force analyzer calculates the WOB based on the compression force measurement from the first strain puck and the compression force measurement from the second strain puck. The strain force analyzer uses the known weight of the drill string in air and the measured forces to calculate the WOB. The strain force analyzer can determine instantaneous WOB or determine an average WOB over a period of time.

At block 205, BOB is calculated. The strain force analyzer calculates a BOB value based on the compression for measurement from one strain puck and the tensile force measurement from the other strain puck. If these forces are unbalanced, it may be an indication of BOB. When forces are applied unevenly, such as when a drill bit encounters a rock ledge on one side of the drill bit, the contact causes compression in portion of the drill bit contacting the ledge. As the compression forces increase on one side, the compression of the drill bit leads to bending toward the applied force. In response, the other side of the drill bit will stretch to balance the forces. Thus, the detection of uneven forces across the drill bit indicates bending toward the side experiencing higher compression forces.

Figure 3:
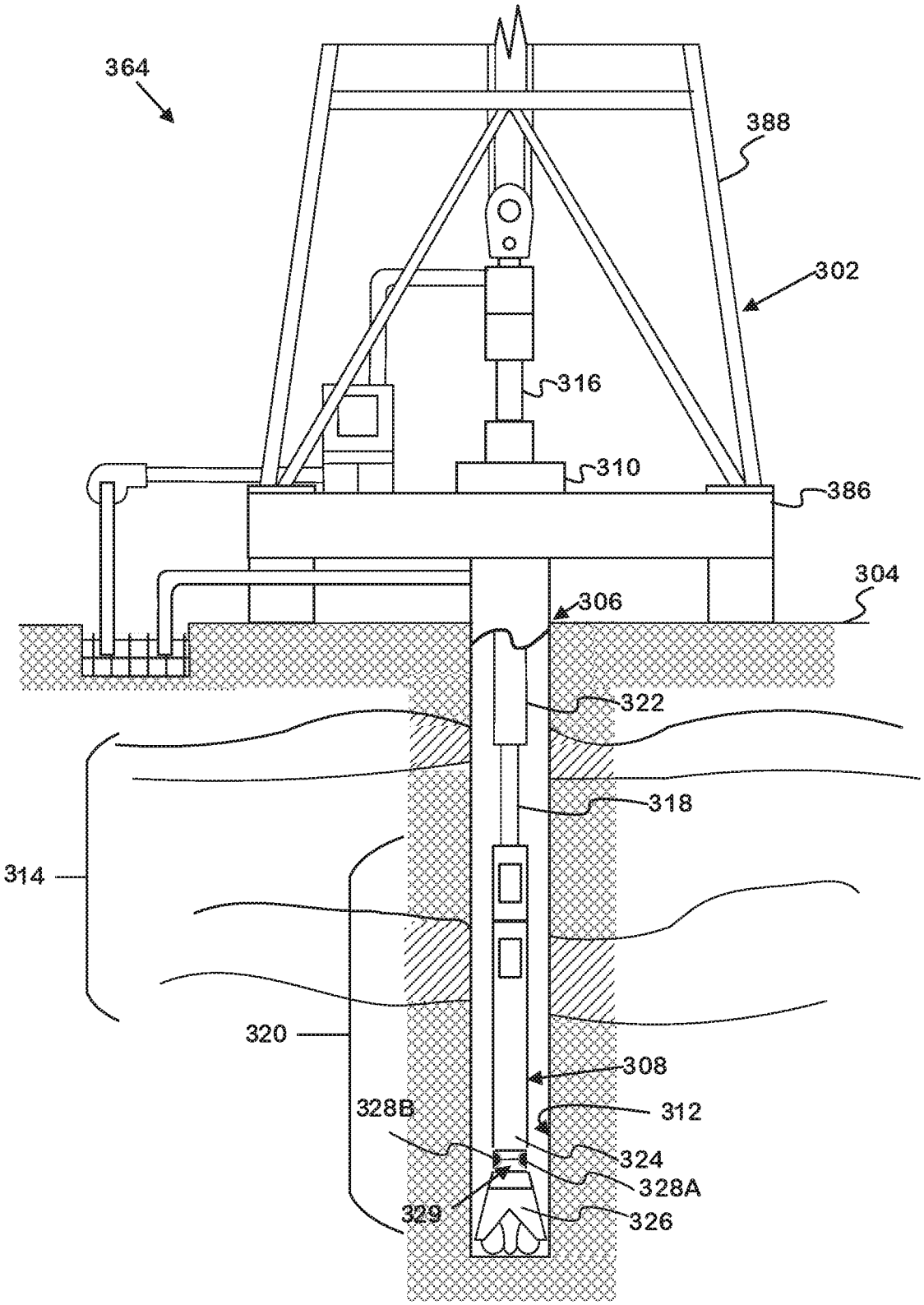
FIG. 3 depicts a drilling rig system employing a drill bit with a dual synchronized multi-puck measurement system.

FIG. 3 depicts a drilling rig system employing a drill bit with a dual synchronized multi-puck measurement package. A system 364 may form a portion of a drilling rig 302 located at the surface 304 of a well 306. Drilling of oil and gas wells is commonly carried out using a string of drill pipes connected to form a drilling string 308 that is lowered through a rotary table 310 into a wellbore or borehole 312. A drilling platform 386 may be equipped with a derrick 388 that supports a hoist.

The drilling rig 302 may thus provide support for the drill string 308. The drill string 308 may operate to penetrate the rotary table 310 for drilling the borehole 312 through subsurface formations 314. The drill string 308 may include a Kelly 316, drill pipe 318, and a bottom hole assembly (BHA) 320, perhaps located at the lower portion of the drill pipe 318.

The BHA 320 may include drill collars 322, a down hole tool 324, and a drill bit 326. The drill bit 326 may operate to create a borehole 312 by penetrating the surface 304 and subsurface formations 314. The drill bit 326 may include measurement packages 328A and 328B housed in the shaft of the drill bit 326. The measurement packages may communicate through wire 329. The down hole tool 324 may comprise any of a number of different types of tools including MWD tools, LWD tools, and others.

During drilling operations, the drill string 308 (perhaps including the Kelly 316, the drill pipe 318, and the bottom hole assembly 320) may be rotated by the rotary table 310. In addition to, or alternatively, the BHA 320 may also be rotated by a motor (e.g., a mud motor) that is located down hole. The drill collars 322 may be used to add weight to the drill bit 326. The drill collars 322 may also operate to stiffen the bottom hole assembly 320, allowing the bottom hole assembly 320 to transfer the added weight to the drill bit 326, and in turn, to assist the drill bit 326 in penetrating the surface 304 and subsurface formations 314.

Figure 4A:
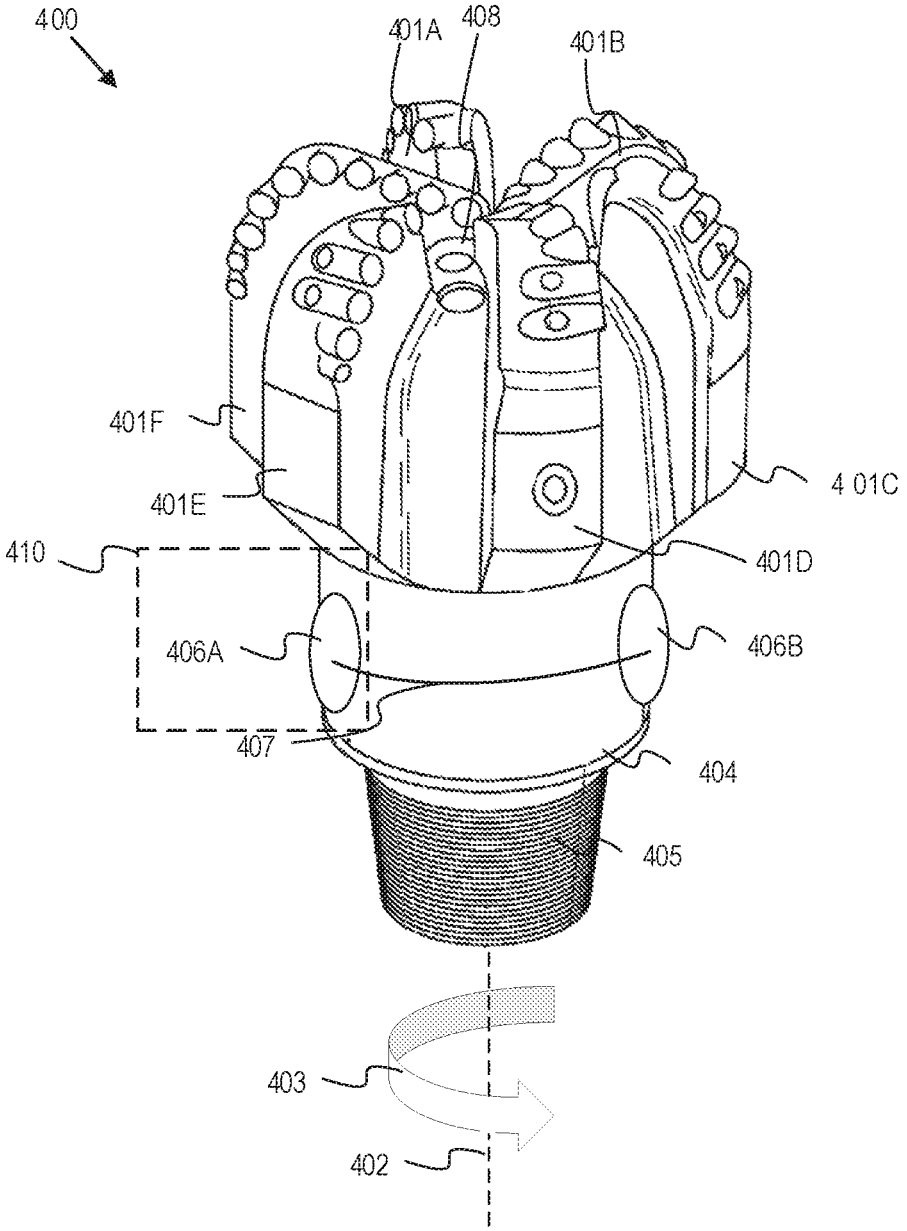
FIG. 4A depicts an isometric view of a drill bit with a multi-puck measurement package in a recess of the shank.

FIG. 4A depicts an isometric view of a drill bit with multi-puck measurement packages housed in recesses at different locations on the shank. A drill bit 400 includes a bit axis 402, which may also be a rotational axis, and a bit face 408 formed on the end of the drill bit that supports cutting structures, or blades. While bit face 408 is depicted as a convex in FIG. 4A, any suitable configuration may also be used. For example, bit face 408 may be flat, concave, or combination of convex and concave. Drill bit 400 supports six blades 401 (e.g., blades 401A-401F) that may be disposed outwardly from exterior portions of the drill bit 400. The blades 401 extend radially across the bit face 408 and longitudinally along a portion of drill bit 400. The blades 401 may be any suitable type of projections extending outwardly from the drill bit 400. The blades 401 may have a wide variety of configurations including substantially arched, helical, spiraling, tapered, converging, diverging, symmetrical, and/or asymmetrical.

Each of the blades 401 may include a first end disposed toward the bit axis 402 and a second end disposed toward outer portions of the drill bit 400 (e.g., disposed generally away from the bit rotational axis 402). The drill bit 400 may rotate with respect to the bit axis 402 in a direction defined by directional arrow 403. The drill bit 400 may include shank 404 with drill pipe threads 405 formed thereon. The threads 405 may be used to releasably engage the drill bit 400 with a BHA, such as BHA 220 of FIG. 2.

The drill bit 300 includes a measurement package 406A and a measurement package 406B. The measurement packages 406A and 406B are removably coupled to the drill bit 400. The measurement packages 406A and 406B are positioned within a separate recessed areas, or cavities, located within an exterior surface of the shank 404 such that a surface of the measurement packages 406A and 406B, including gauges and a pressure cap, faces radially outward from the shank 404 and the bit axis 402 to collect data indicating downhole forces applied to the drill bit 400. Downhole forces applied to the shank 404 of the drill bit 400 may be similarly applied to the measurement packages 406A and 406B and, in turn, to the gauges. The gauges contained in the measurement packages 406A and 406B may include transmitters used to transmit data indicating downhole forces and drill bit motion and vibration to one or more receivers to allow the data from each gauge to be analyzed.

The shank 404 includes two measurement packages 406A and 406B. The two measurement packages 406A and 406B are depicted as being disposed within the shank 404 at locations approximately 180 degrees from one another to collect data indicating compression and bending forces applied to the shank 404 during drilling operations. However, the number of measurement packages coupled to the shank 404 may depend upon anticipated downhole drilling conditions and/or the type of downhole forces for which data is to be collected. As such, any number of measurement packages may be inserted into cavities in the shank 404. The measurement packages 406A and 406B communicate through wire 407. In embodiments with more than two measurement packages, communication between additional measurement packages could be performed by additional wires connecting the measurement packages.

Figure 4B:
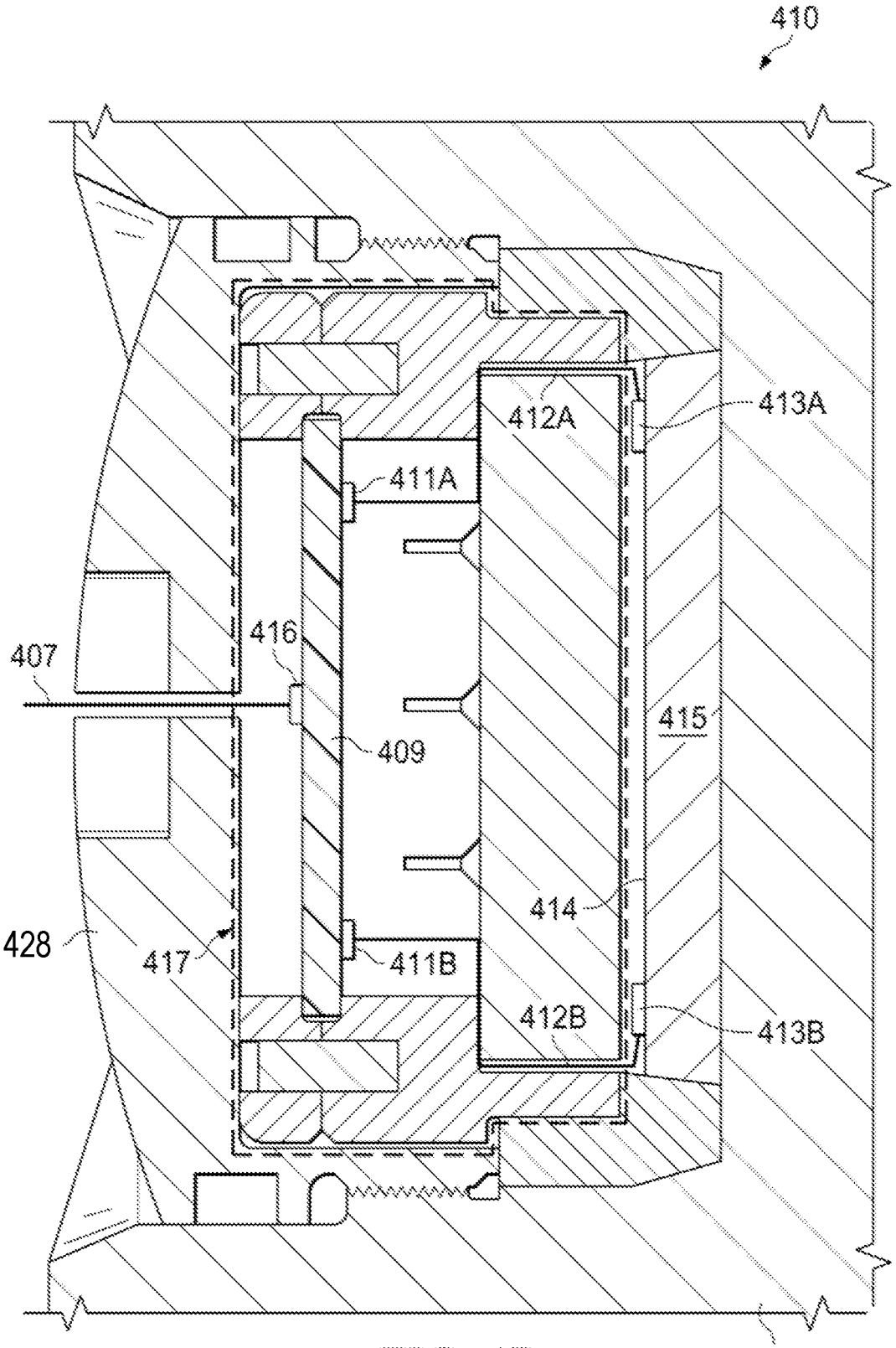
FIG. 4B depicts a cross sectional view of the part of the shank and one multi-puck measurement package of FIG. 4A.

FIG. 4B depicts a cross sectional view of the part of the shank and one multi-puck measurement package of FIG. 4A. FIG. 43B depicts a measurement package 410, which is substantially similar to measurement package 100 of FIG. 1, recessed in a cavity in a shank 404 of a drill bit, such as drill bit 400 of FIG. 4A. The measurement package 410 consists, in part, of a pressure cap 428, a motion puck 417, and a strain puck 415. Some components previously described in FIG. 1, such as a battery or a PCB holder, are not labelled for ease of illustration. The motion puck 417 is communicably coupled to the strain puck 415 through a PCB 409. While FIG. 1 depicts an example embodiment in which a connector on contacting surfaces of the motion puck and the strain puck couples the two pucks, FIG. 4B depicts an example embodiment in which wires connect the PCB directly to strain gauges. Wires 412A and 412B allow for communication between strain gauges 413A and 413B on a surface 414 of the strain puck 415. The wires 412*a* and 412B connect and transmit information to the PCB 409 through connection ports 411A and 411B, respectively. The PCB 409 may include a processor which can synchronize the data between the sensors in the PCB and the strain gauges 413A and 413B of the strain puck 415. Another connection port 416 on the PCB 409 allows for communication between PCBs of different measurement packages. A wire 407, connected to the PCB 409 through connection port 416, passes through a hollow passage in the pressure cap 428. The wire 407 wraps around the outer circumference of the shank 404 to connect to a similar port in another PCB to allow for communication between the measurement packages.

While FIG. 1 and FIG. 4 depict two embodiments of connections between a motion puck and a strain puck of a multi-puck measurement package, other configurations may also be used. In one embodiment, the contacting surfaces of the motion puck and the strain puck may include connector interface. The connector interfaces may be electrical connectors configured to align with each other (e.g., a male tip configured to fit into a female port). The connector interface communicatively couples the two pucks. For example, the contacting surface of the motion puck includes a connector interface with a male connection. The connector interface contains internal wires connected to the PCB. The contacting surface of the motion puck includes a female connection with internal wires connected to the strain gauges. When the motion puck is plugged in to the strain puck through the connector interfaces, data from the strain gauges is communicated to the PCB.

Figure 5:
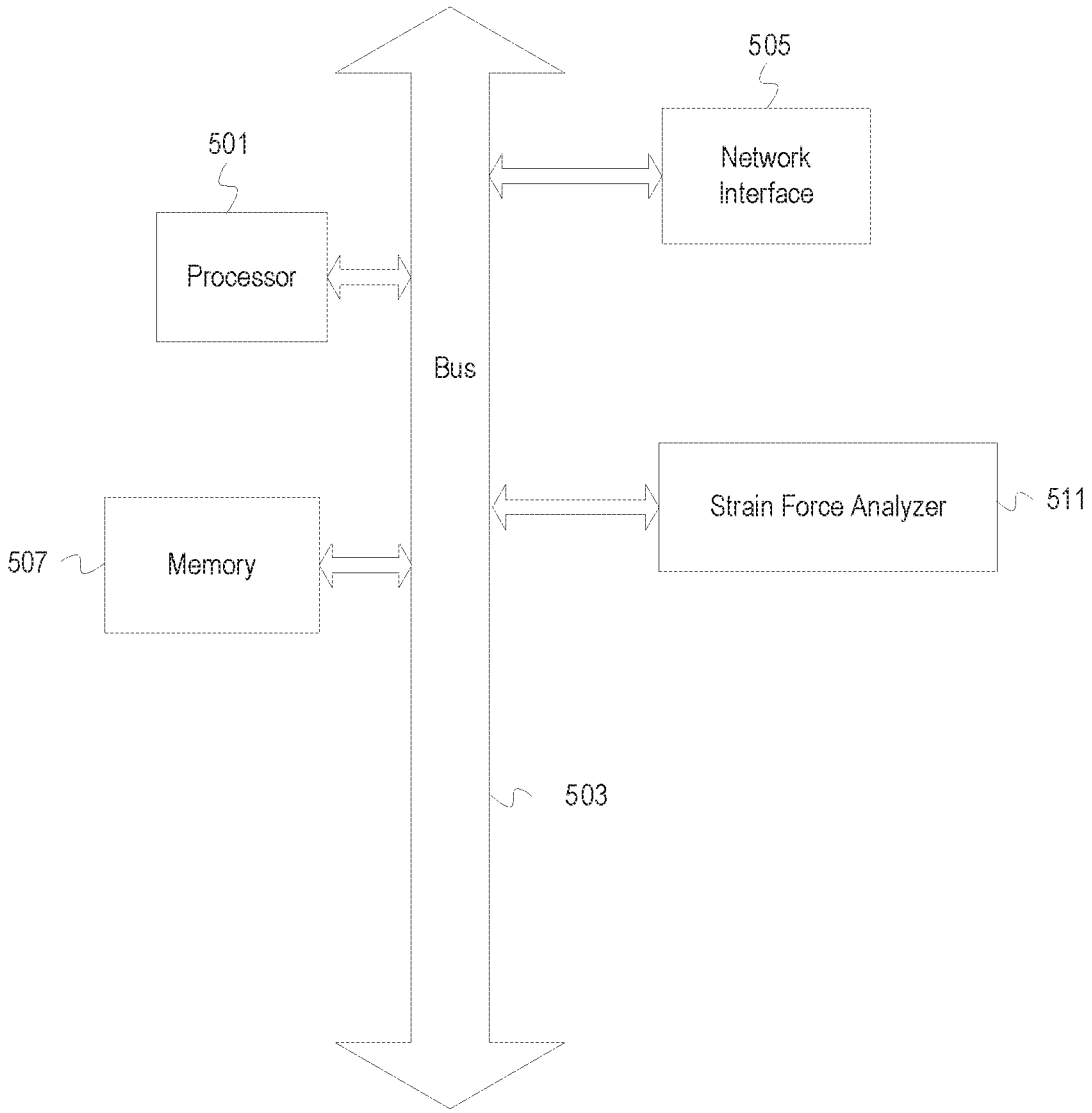
FIG. 5 depicts an example system for analyzing strain forces based on a dual synchronized multi-puck measurement system.

FIG. 5 depicts an example system for analyzing downhole forces based on a dual synchronized measurement puck system. The system includes a processor 501 (possibly including multiple processors, multiple cores, multiple nodes, and/or implementing multi-threading, etc.). The system includes a digital memory 507. The digital memory 507 may be system memory or any one or more of the above already described possible realizations of machine-readable media. The system also includes a bus 503 and a network interface 505.

The system also includes a strain force analyzer 511. The strain force analyzer 511 may perform the function of comparing strain measurements and determining strain forces from the data acquired by the measurement packages. Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). The processor 501 and the network interface 505 are coupled to the bus 503. Although illustrated as being coupled to the bus 503, the memory 507 may be coupled to the processor 501.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instruction stored in one or more machine-readable media. Accordingly, aspects may take the form of hardware, software (including firmware, resident software, micro-code, etc.), or a combination of software and hardware aspects that may all generally be referred to herein as a circuit, module or system. The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for removing wax from a production tubing string as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

A downhole drilling tool comprises an earth-boring drill bit including a bit body and a shank coupled to the bit body. The drill bit includes a motion puck positioned in a cavity of the shank, the motion puck including a motion sensor to detect movement indicating a force applied to the earth-boring drill bit during a drilling operation. The drill bit includes a strain puck positioned in the cavity of the shank. The strain puck includes a strain gauge to measure the force applied to the earth-boring drill bit during the drilling operation. The drill bit includes a plurality of blades disposed on exterior portions of the bit body, each blade having respective cutting elements disposed thereon. In some embodiments, the motion puck is positioned in the cavity of the shank such that the motion puck is in contact with the strain puck. The motion puck can be in contact with the strain puck through a face of the motion puck being in contact with a face of the strain puck. In some embodiments, the motion puck comprises a processor that is electrically coupled to the motion sensor, wherein the strain gauge is electrically coupled to the processor through the face of the motion puck being in contact with the face of the strain puck. The processor can be configured to execute programmable code to cause the processor to synchronize the motion sensor and the strain gauge. In some embodiments, the force comprises at least one of a compression force and a tensile force. The motion sensor can include at least one of a gyroscope, an accelerometer, and a magnetometer.

A downhole drilling system includes a drill string that includes a drill pipe and a bottom hole assembly. The bottom hole assembly comprises a drill bit having a cavity. The drill bit includes a motion puck positioned in the cavity. The motion puck includes a motion sensor to detect movement indicating a force applied to the drill bit during a drilling operation. The drill bit includes a strain puck positioned in the cavity such that the strain puck is in contact with the motion puck. The strain puck includes a strain gauge to measure the force applied to the drill bit during the drilling operation. In some embodiments, the motion puck is in contact with the strain puck through a face of the motion puck being in contact with a face of the strain puck. The motion puck can include a processor that is electrically coupled to the motion sensor, wherein the strain gauge is electrically coupled to the processor through the face of the motion puck being in contact with the face of the strain puck. The processor can be configured to execute programmable code to cause the processor to synchronize the motion sensor and the strain gauge. In some embodiments, the force comprises at least one of a compression force and a tensile force. The motion sensor can include at least one of a gyroscope, an accelerometer, and a magnetometer. In some embodiments, the cavity is in a shank of the drill bit.

A method comprises receiving, from a motion sensor in a motion puck positioned in a cavity of a subassembly of a drill bit, data indicating movement caused by a force applied to the drill bit during a drilling operation. The method includes receiving, from a strain gauge in a strain puck positioned in the cavity of the subassembly of the drill bit, data representative of the force applied to the drill bit during the drilling operation. The method includes analyzing the data representative of the force and the data indicating movement caused by the force applied to the drill bit during the drilling operation to determine a value of one or more drilling parameters. The method includes modifying the one or more drilling parameters of the drilling operation based on the determined value of the one or more drilling parameters. In some embodiments, analyzing the data comprises calculating a weight on the drill bit based on the data representative of the force and the data indicating movement caused by the force applied to the drilling bit during the drilling operation, wherein modifying the one or more drilling parameters comprises modifying the weight on the drill bit. In some embodiments, the motion puck is in contact with the strain puck through a face of the motion puck being in contact with a face of the strain puck. The motion puck can include a processor that is electrically coupled to the motion sensor, wherein the strain gauge is electrically coupled to the processor through the face of the motion puck being in contact with the face of the strain puck. The receiving, from the strain gauge, the data representative of the force applied to the drill bit can include receiving, by the processor, the data representative of the force applied to the drill bit through electrical coupling through the face of the motion puck being in contact with the face of the strain puck. In some embodiments, the method includes synchronizing, by the processor, the motion sensor and the strain gauge. The force can include at least one of a compression force and a tensile force. The motion sensor can include at least one of a gyroscope, an accelerometer, and a magnetometer.

What is claimed is:

1. A downhole drilling tool comprising:
an earth-boring drill bit including,
a bit body;
a shank coupled to the bit body;
a motion puck positioned in a cavity of the shank, the motion puck including a motion sensor to detect movement indicating a force applied to the earth-boring drill bit during a drilling operation; and
a strain puck positioned in the cavity of the shank, the strain puck including a strain gauge to measure the force applied to the earth-boring drill bit during the drilling operation;
a processor coupled to the motion puck and electronically coupled to the motion sensor, wherein the processor is to execute programmable code to cause the processor to synchronize the motion sensor and the strain gauge; and
a plurality of blades disposed on exterior portions of the bit body, each blade having respective cutting elements disposed thereon.

2. The downhole drilling tool of claim 1, wherein the motion puck is positioned in the cavity of the shank such that the motion puck is in contact with the strain puck.

3. The downhole drilling tool of claim 2, wherein the motion puck is in contact with the strain puck through a face of the motion puck being in contact with a face of the strain puck.

4. The downhole drilling tool of claim 3, wherein the strain gauge is electrically coupled to the processor through the face of the motion puck being in contact with the face of the strain puck.

5. The downhole drilling tool of claim 1, wherein the force comprises at least one of a compression force and a tensile force.

6. The downhole drilling tool of claim 1, wherein the motion sensor comprises at least one of a gyroscope, an accelerometer, and a magnetometer.

7. The downhole drilling tool of claim 1, further comprising a pressure cap which protects electronic components within the motion puck and the strain puck.

8. A downhole drilling system comprising:
a drill string including,
a drill pipe; and
a bottom hole assembly that includes a drill bit having a cavity, the drill bit including,
a motion puck positioned in the cavity, the motion puck including a motion sensor to detect movement indicating a force applied to the drill bit during a drilling operation;
a strain puck positioned in the cavity such that the strain puck is in contact with the motion puck, the strain puck including a strain gauge to measure the force applied to the drill bit during the drilling operation; and
a processor coupled to the motion puck and electronically coupled to the motion sensor, wherein the processor is to execute programmable code to cause the processor to synchronize the motion sensor and the strain gauge.

9. The downhole drilling system of claim 8, wherein the motion puck is in contact with the strain puck through a face of the motion puck being in contact with a face of the strain puck.

10. The downhole drilling system of claim 9, wherein the strain gauge is electrically coupled to the processor through the face of the motion puck being in contact with the face of the strain puck.

11. The downhole drilling system of claim 8, wherein the force comprises at least one of a compression force and a tensile force.

12. The downhole drilling system of claim 8, wherein the motion sensor comprises at least one of a gyroscope, an accelerometer, and a magnetometer.

13. The downhole drilling system of claim 8, wherein the cavity is in a shank of the drill bit.

14. The downhole drilling system of claim 8, further comprising a pressure cap which protects electronic components within the motion puck and the strain puck.

15. A method comprising:
receiving, from a motion sensor in a motion puck positioned in a cavity of a subassembly of a drill bit, data indicating movement caused by a force applied to the drill bit during a drilling operation;
receiving, from a strain gauge in a strain puck positioned in the cavity of the subassembly of the drill bit, data representative of the force applied to the drill bit during the drilling operation;

analyzing the data representative of the force and the data indicating movement caused by the force applied to the drill bit during the drilling operation to determine a value of one or more drilling parameters;

synchronizing, via a processor coupled to the motion puck and electronically coupled to the motion sensor, the motion sensor and the strain gauge; and modifying the one or more drilling parameters of the drilling operation based on the determined value of the one or more drilling parameters.

16. The method of claim 15, wherein analyzing the data comprises calculating a weight on the drill bit based on the data representative of the force and the data indicating movement caused by the force applied to the drilling bit during the drilling operation, and wherein modifying the one or more drilling parameters comprises modifying the weight on the drill bit.

17. The method of claim 15, wherein the motion puck is in contact with the strain puck through a face of the motion puck being in contact with a face of the strain puck, wherein the strain gauge is electrically coupled to the processor through the face of the motion puck being in contact with the face of the strain puck, wherein receiving, from the strain gauge, the data representative of the force applied to the drill bit comprises receiving, by the processor, the data representative of the force applied to the drill bit through electrical coupling through the face of the motion puck being in contact with the face of the strain puck.

18. The method of claim 15, wherein the force comprises at least one of a compression force and a tensile force.

19. The method of claim 15, wherein the motion sensor comprises at least one of a gyroscope, an accelerometer, and a magnetometer.

* * * * *